US007656266B2

(12) United States Patent
Chang

(10) Patent No.: US 7,656,266 B2
(45) Date of Patent: Feb. 2, 2010

(54) TOROIDAL STAR-SHAPED TRANSFORMER

(76) Inventor: Kern K. N. Chang, 30 Sagebursh La., Langhorne, PA (US) 19047

( * ) Notice: Subject to any disclaimer, the term of this patent is extended or adjusted under 35 U.S.C. 154(b) by 188 days.

(21) Appl. No.: 12/008,206

(22) Filed: Jan. 9, 2008

(65) Prior Publication Data

US 2009/0174518 A1 Jul. 9, 2009

(51) Int. Cl.
*H01F 27/28* (2006.01)

(52) U.S. Cl. ..... 336/229; 336/180; 336/206; 336/225; 336/234; 324/127; 324/232; 324/258

(58) Field of Classification Search ..... 336/200, 336/225, 229, 232, 234
See application file for complete search history.

(56) References Cited

U.S. PATENT DOCUMENTS 3,054,976 A * 9/1962 Lipshutz ..... 336/136
3,235,790 A * 2/1966 Collins ..... 323/347
3,546,580 A * 12/1970 Williams ..... 324/258
4,694,246 A * 9/1987 Avisse ..... 324/207.18
6,300,857 B1 * 10/2001 Herwig ..... 336/229
2004/0212362 A1 * 10/2004 Baudendistel et al. ..... 324/232
2005/0001709 A1 * 1/2005 Pais et al. ..... 336/229
2007/0046413 A1 * 3/2007 Yamashita et al. ..... 336/96

FOREIGN PATENT DOCUMENTS

JP 06120024 A * 4/1994

* cited by examiner

*Primary Examiner*—Anh T Mai
*Assistant Examiner*—Tszfung Chan
(74) *Attorney, Agent, or Firm*—Carl Giordano

(57) ABSTRACT

A toroidal power transformer is disclosed. The toroidal power transformer comprises a circular core composed of plurality of laminated electrically conductive materials, a plurality of multi-layered first windings radially wound around the circular core, said winding arranged with an angular spacing of 2θ and a number of windings in each winding layer is less than a number of windings in each previous layer, a multi-layered second winding radially wound around the circular core covering a corresponding one of said plurality of first windings, wherein the layers of each of said second windings are arranged to form a substantially triangular cross-section; and an insulating layer between each of said first and second windings.

21 Claims, 6 Drawing Sheets

TOROIDAL STAR-SHAPE TRANSFORMER

SINGLE PHASE

THREE PHASE

TOROIDAL STAR-SHAPE TRANSFORMER

TOROIDAL STAR-SHAPED TRANSFORMER

FIELD OF THE INVENTION

The present invention is related to the field of power transformers and more particularly to a toroidal transformer with star-shaped winding configuration.

BACKGROUND OF THE INVENTION

Transformers, via which electrical voltage is up-converted for transmission over large distance and down-converted for delivery to local customers, is a century old technology, developed with the advent of electrical technology.

After years of technical progress, power transformers have achieved good performance, but still suffer a significant amount of power loss. This power loss is caused principally by the excessively long core in the process of stepping-up or stepping-down an applied input voltage. As the available energy source, oil, for electrical power generation becomes more expensive, and controversial, a reduction in the power lost in power transformers becomes increasing more desirable.

With respect to energy savings, the present state of the art, with substantially rectangular configuration inherits two major problems: an irregular, non-uniform electrical field and a heat-accumulating winding assembly.

Hence, there is a need in the industry for a power transformer configuration that provides for significant reduction in the power loss generated within the transformer.

SUMMARY OF THE INVENTION

The present invention discloses a power transformer that comprises a circular core composed of plurality of laminated electrically conductive materials, a plurality of multi-layered first windings radially wound around the circular core, said winding arranged with an angular spacing of 2θ and a number of windings in each winding layer is less than a number of windings in each previous layer, a multi-layered second winding radially wound around the circular core covering a corresponding one of said plurality of first windings, wherein the layers of each of said second windings are arranged to form a substantially triangular cross-section; and an insulating layer between said first and second windings.

BRIEF DESCRIPTION OF THE DRAWINGS

For a better understanding of the invention, reference is now made to the drawings wherein.

Figure 1A:
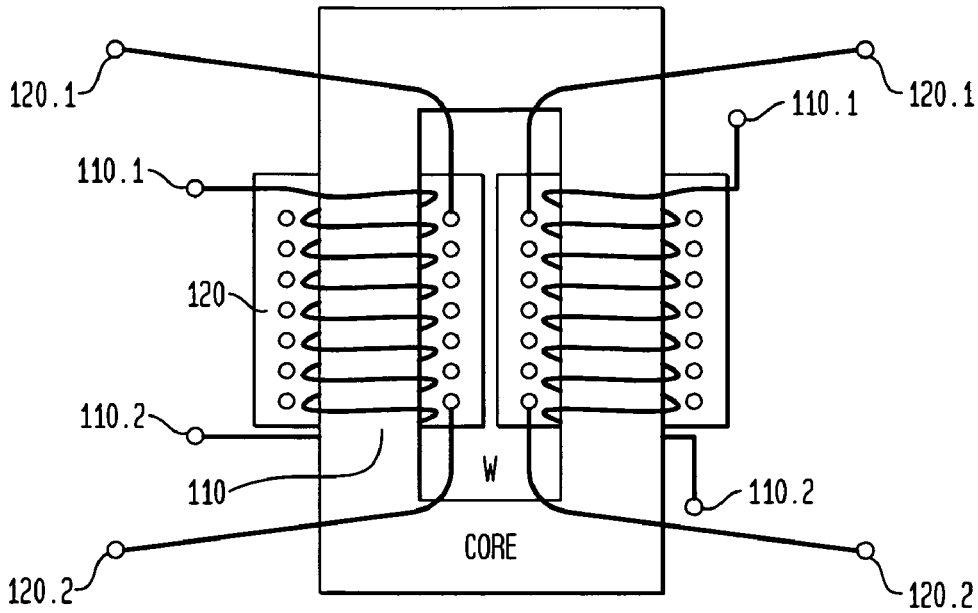
FIG. 1A (PRIOR ART)
FIGS. 1A and 1B illustrate cross-sectional views of a conventional single-phase rectangular transformer and a regular three-phase power transformer, respectively.

It is to be understood that these drawings are solely for purposes of illustrating the concepts of the invention and are not intended as a definition of the limits of the invention. The embodiments shown in the figures herein and described in the accompanying detailed description are to be used as illustrative embodiments and should not be construed as the only manner of practicing the invention. Also, the same reference numerals, possibly supplemented with reference characters where appropriate, have been used to identify similar elements.

DETAILED DESCRIPTION OF THE INVENTION

Figure 1B:
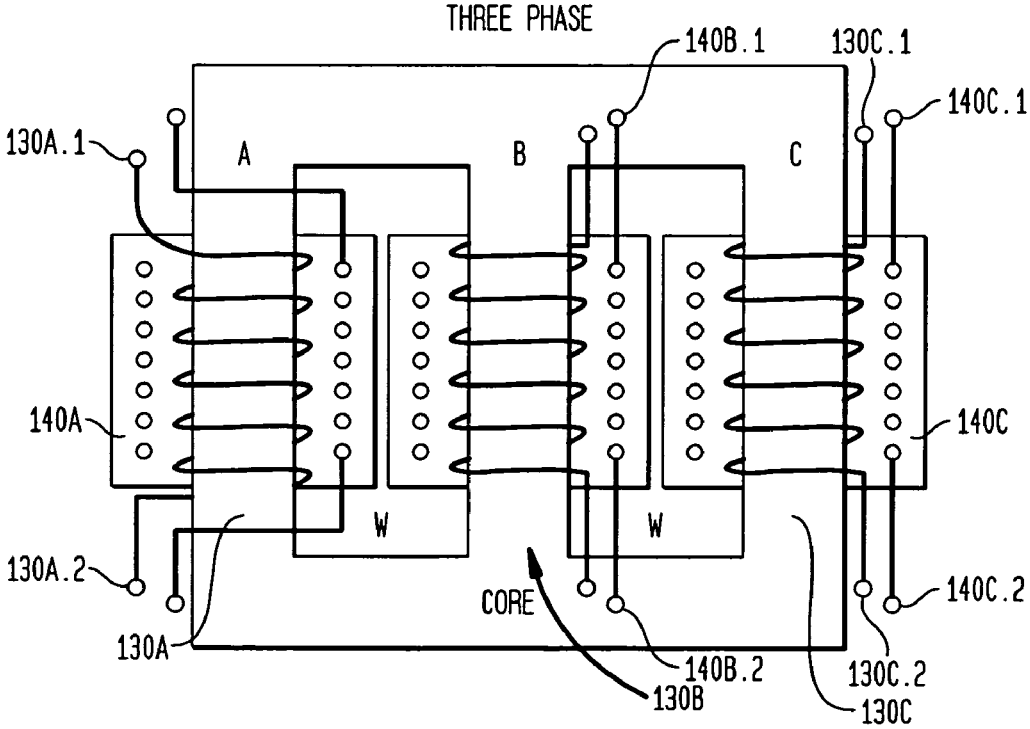
FIG. 1B (PRIOR ART)

FIGS. 1A and 1B illustrate cross-sectional views of a regular single phase rectangular transformer and a regular three-phase rectangular transformer showing their respective internal configurations. Generally, a plurality of winding are placed around respective legs of a laminated magnetic core. Magnetic cores provide a convenient and effective means for controlling the magnetic field generated in the windings by the applied electrical energy. With reference to FIG. 1A, windings 110 may represent an input winding accepting an input voltage across nodes 110.1 and 110.2 and windings 120 represent an output winding from which an output voltage is obtained across nodes 120.1 and 120.2. In a step-up power transformer, for example the number of output windings 120 is greater than the number of input windings 110 so as to obtain a step-up of the input voltage. Similarly, in a step-down transformer the number of output windings 120 is less than the number of input windings 110. Thus, the transformer shown in FIG. 1A may represent either a step-up or a step-down transformer depending upon the choice of the input and output terminals.

With reference to FIG. 1B, a regular three-phase power transformer shows a laminated rectangular core consisting of three branch legs, referred to a A, B and C, for three sets of independently wound windings that carry voltages of the same amplitudes but with different phase angles of 0°, 120°, and 240°. Close to the core wall is a low voltage winding 130 insulated from a coupled high voltage winding 140. For example, with regard to leg A, low voltage is applied to inputs terminals 130A1 and 130A2 and a high voltage is output from terminals 140A1 and 140A2. Similar inputs and outputs are shown with regard to legs B and C. While the input voltage is applied either to the low voltage windings for the step-up case or to the high voltage windings for the step-down case, the low-voltage windings are typically wound close to the grounded core wall.

The crucial parameter to control the power loss in any transformer is the ratio (K) of core window space (w) to windings space. Window space (w) and insulation space are shown in FIGS. 1A and 1B. Ample insulation space is necessary between the low voltage 130 and high voltage windings 140 and between the winding to the grounded core to stabilize temperature rise and also to prevent any voltage breakdown. A regular rectangular core with its windings cylindrically lumped around the core produces an enormously complex electrical field that requires a large window space to achieve a desirable operative performance. Typically, a regular 50 KVA transformer has a value of K=1.96 while a regular 315 KVA transformer has a value of K=2.56. The larger value of ratio K, the longer is the laminated core, the heavier the transformer, greater the power loss and the greater the temperature rise.

Figure 2:
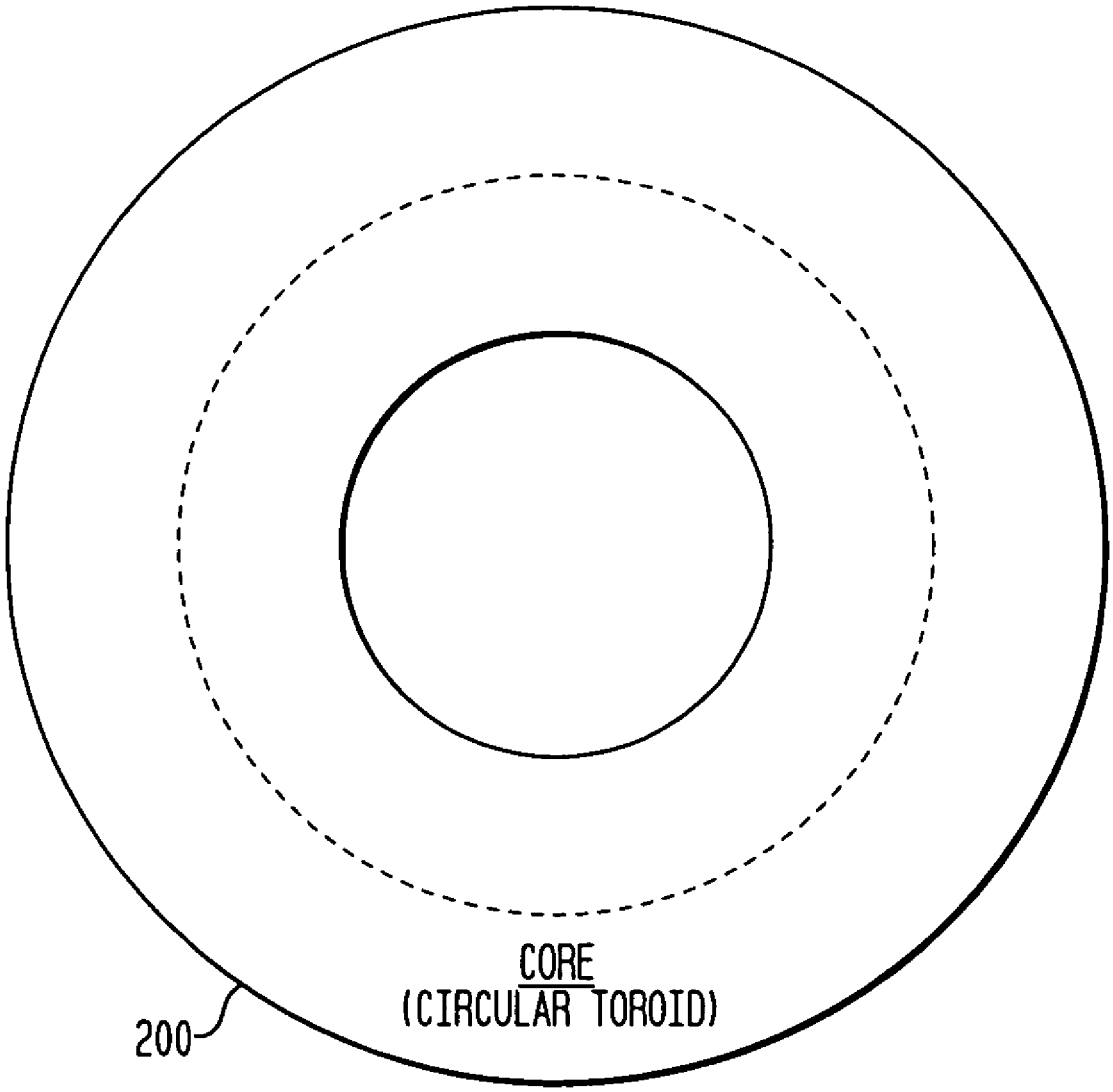
FIG. 2 illustrates a plan view of a conventional toroidal magnetic core transformer in accordance with the principles of the invention.

FIG. 2 illustrates a regular circular laminated magnetic core 200 diameter (d) fabricated with multiple thin silicon steel sheets of different sizes stacked in a close circular shape. The total sheets area is always smaller than the circular core resulting in a filling factor δ of the order of 0.9, which is used as the basis for actual flux production.

Figure 3A:
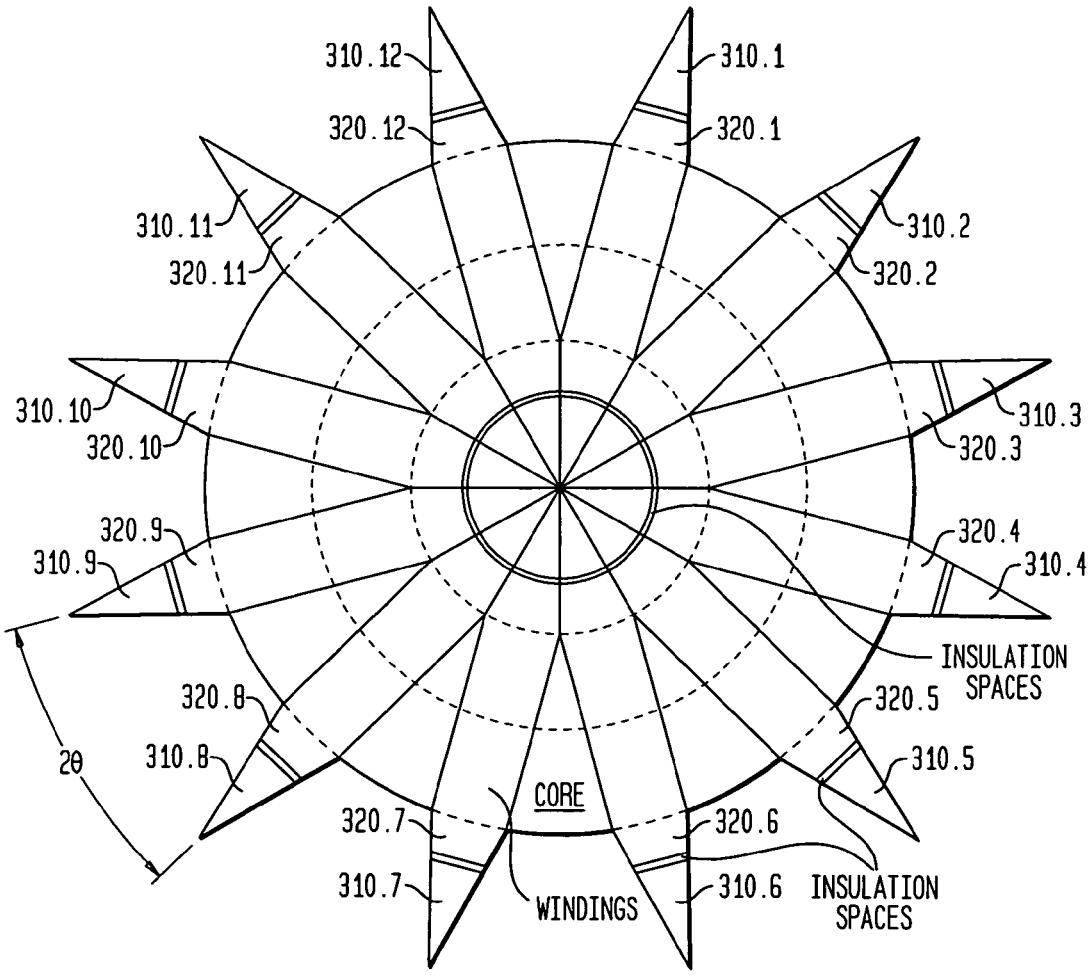
FIG. 3A illustrates a plan view of a first exemplary embodiment of a toroidal star-shaped transformer in accordance with the principles of the invention.

FIG. 3A illustrates a plan view of an exemplary toroidal transformer with sets of separate windings sections formed in substantially triangular form and spread out in multiple star forms in accordance with the principles of the invention. Each set of windings sections comprises a low-voltage (i.e., first) winding 320 close to the core wall and a coupled high voltage (second) winding 310. In the illustrated example shown in FIG. 3A, the toroidal star shaped transformer 300 is composed of twelve (12) substantially equal windings sections. In this case, low voltage windings 310.1-310.12 are wound in a trapezoid form close to the circular core and the high voltage windings 320.1-320.12 are wound on top of the low-voltage windings and electrically isolated from the low voltage windings.

Figure 3B:
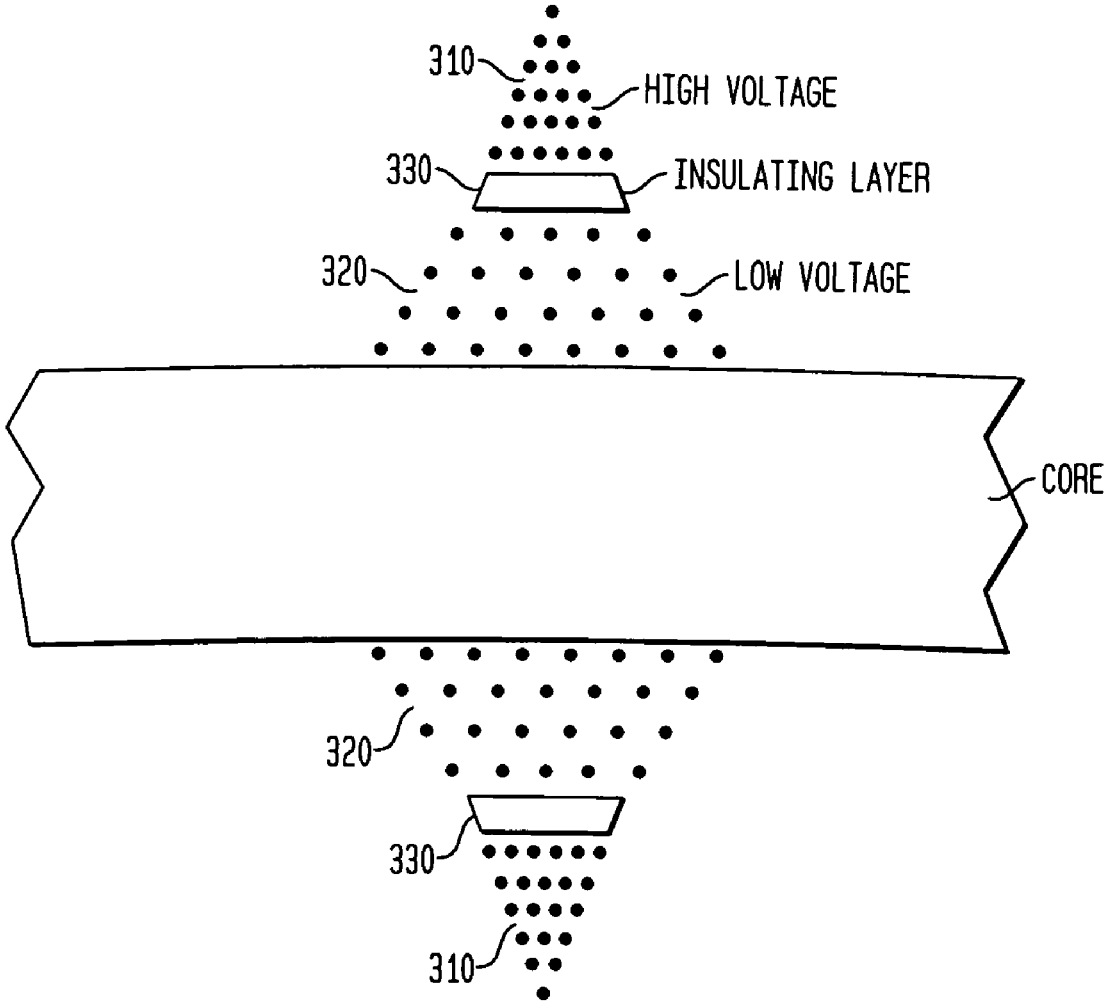
FIG. 3B illustrates a cross-sectional view of low and high voltage windings of a single winding section around a magnetic core in accordance with the principles of the invention.

FIG. 3B illustrates a cross-sectional view of a star-shaped low voltage windings and high voltage windings wound around the core in accordance with the principles of the invention. In this exemplary embodiment, the low voltage windings 320 are positioned in close contact with the core in a manner to form substantially a trapezoid cross section, wherein the number of windings in each winding layer is less than a number of windings in a previous layer. Accordingly, the low voltage winding is wound around the laminated core in a manner to achieve a substantially triangular cross-section shape. It would be recognized that if the number of layers is terminated prior to achieving a full triangular cross-section, the cross-section of the low voltage windings represents a trapezoidal shape.

The high voltage windings 310 are similarly wound around the core atop a plateau formed on the top of the substantially trapezoidal low voltage windings. The high voltage winding have also progressively fewer windings in subsequent layer resulting in a substantially triangular cross-section shape. Between the high 310 and low voltage 320 windings is an insulation layer 330. The insulation layer prevents electrical shorting between the windings and is a non-electrical material. In large KiloVoltAmpere (KVA) transformers the insulating layer may be an oil, for example, that assists in reducing the heat generated in the transformer.

In a single-phase transformer in accordance with the principles of the invention, all windings sections have substantially the same amplitude and phase angle. In the three-phase transformer, the windings sections are organized in groups of three that carry substantially the same voltage but with different phase angles. Preferably the phase angles are separated by 120 degrees (e.g., 0, 120 and 240 degrees). In one aspect (the preferred), second windings 310.1, 310.2, 310.3 and 310.4 (and corresponding first windings) may be associated with a first phase while second windings 310.5-310.8 (and corresponding first windings) may be associated with a second phase. The remaining windings may be associated with a third phase. In another aspect, second windings 310.1, 310.2, 310.3 and 310.12 (and corresponding first windings) may be associated with a first phase while second windings 310.4-310.7 (and corresponding first windings) may be associated with a second phase. The remaining windings may be associated with a third phase. In another aspect, second windings 310.1, 310.4,310.7 and 310.10 (and associated first windings) may be associated with a first phase, second windings 310.2, 310.5, 310.8 and 310.11 (and associated first windings) may be associated with a second phase. The remaining windings may be associated with a third phase. Other organizations of winding groups may be also be contemplated in accordance with the principles of the invention. Adequate insulation is provided between each of the windings associated with each phase.

Winding the high and low voltage windings in this manner results in less wiring in the free space of the circular transformer core. For example in the illustrated twelve windings shown in FIG. 3A, the polygon window has a parameter equivalent to the core length which is about 30% shorter than that with a regular window. This results in shorter cores, which results in savings in both cost and power loss. In addition to the geometric savings in the core length, another savings lies in the substantially triangular winding configuration where a uniform electric field exists between the window center and wall, in contrast to the non-uniform one formed in a regular transformer employing a rectangular structure.

Thus, a much larger window is needed in a regular rectangular transformer to provide sufficient insulating space in case of voltage breakdown resulting from the non-uniform field. For instance, a typical 50 KVA transformer requires an insulating space of 61% of the window while a regular 315 KVA transformer requires 48% of the window. In contrast, the star-shaped transformer with the same ratings and winding turns requires only 20% and 29%, respectively, of the window space.

The disclosed star-shaped transformer is primarily equipped with a unique set of separate star-shaped triangular windings, unlike the conventional lumped windings of a rectangular transformer. The star-shape is favorable for radiation of unavoidable heat resulting from power loss. The toroidal structure shown is well suited to confine the magnetic flux lines with the core with little leakage. Leakage results in inefficient coupling and undesirable spurious power loss.

Considering now Faraday's law for electro-magnetics which teaches that an effective voltage V induced in a coil by an applied voltage is equal to the negative product of the number of turns and the rate of change of flux lines.

$$V\sqrt{2} = -N\frac{d\phi}{dt} = -NA\frac{dB}{dt}$$

For a sinusoidal applied source at a frequency (f) this may be expressed as:

$$NA = \frac{V\sqrt{2}}{2\pi fB}. \tag{1}$$

A classic geometric theory states that the perimeter length of any closed plane region enclosing a given area is always longer than that of a circle with the same area. For a polygon loop enclosed with a given area may be represented as:

$$\beta = \sqrt{\alpha \mathrm{Tan}\theta} \geq \sqrt{\pi} \tag{2}$$

where: N is the number of winding turns;

A is the cross section core area;

V is the applied voltage f is the power source frequency;

B is the flux density;

α is the number of sections each with an apex of 2θ (=2π/α);

$2\beta^2$ is a ratio of the perimeter length of the triangular-formed sections (polygons) to its triangular height.

When the inner perimeter of a core takes the polygon shape shown in FIG. 3A, the volume of the core consists of the two partitions: (1) total of 12, in this illustrated case, cylinders with a cross-section area of:

$$\frac{\pi d^2}{4}$$

and (2) total of 12 connecting slices between cylinders is equal to:

$$\frac{1}{4}\delta\pi^2 d^3$$

Depending upon the source frequency and the chosen materials for the core and wire, a constant, Q, may be determined as:

$$Q = \frac{2\sqrt{2}}{\sigma B\pi^2 f\delta}$$

Combining the above formulations it may be determined that:

$$V_c = \frac{1}{4}(\delta\pi^2 d^3)\left[1 + \frac{2\sqrt{2}}{\pi d^2}(PQK]\right)^{1/2}\beta\Bigg] \quad (3)$$

and $$V_w = \frac{2PQ}{d}(\pi)\left[1 + \frac{2\sqrt{2}}{3d^2}(PQK]\right)^{1/2}\frac{1}{\beta}\Bigg] \quad (4)$$

where $V_c$ is core volume;

$V_w$ is the winding volume;

δ is the core filling factor;

P the rated power capacity (Volts×Amperes);

Q is a constant for a given values of winding conductivity, source frequency and flux density;

d is the core diameter; and

K is the ratio of window space to the winding space.

Referring to the above equations, a toroidal transformer may be designed in accordance with the principles of the invention. Specifically, either a core diameter (d) or the number of windings (N) may be chosen independently. From equation 1, core diameter or number of windings may be determined based on the cost of either energy or material. That is, a trade-off may be depending upon the cost of cooper wire used for the windings or steel/laminates used for the core.

Table 1 illustrates data typical 50KVA and 315KVA transformers of the toroidal configuration shown herein and traditional rectangular transformers.

| | 50 KVA d = .11 m, $N_{Input}$ = 67, $V_I$ = 220 V ($N_{Output}/N_{Input}$ = 45) | | | 315 KVA d = .185 m, $N_{Input}$ = 31, $V_I$ = 231 V ($N_{Output}/N_{Input}$ = 25) | | |
|---|---|---|---|---|---|---|
| | Toroidal | Rectangular | Improvement | Toroidal | Rectangular | Improvement |
| Core Vol. ($m^3$) | .00724 | .01125 | 36% | .0334 | .0722 | 53.7% |
| Wdgs. Vol. ($m^3$) | .00813 | .00876 | 7.2% | .0301 | .0304 | 1.2% |
| Core wt. (kg) | 55.4 | 86.1 | 36% | 255 | 552 | 53.7% |
| Wdgs. wt. (kg) | 72.0 | 78.0 | 7.2% | 267 | 272 | 1.2% |

The terms $(PQK)^{1/2}$, β and d in Equations 3 and 4 uniquely define the window shape and size which in turn fixes the required rated power capacity. From Table 1, it can be seen that the toroidal transformer, in accordance with the principles of the invention, is smaller and lighter, requiring less base materials for the core and windings than a conventional power transformer. That is, for a given window area, regular polygons have shorter perimeter lengths than irregular ones and polygons with more sides have also shorter perimeters lengths than those with less sides. The window can be either a rectangular one for a maximum perimeter length or a circular one for a minimum perimeter length. Conventional power transformers have rectangular windows (e.g., FIG. 1A) resulting in longer cores than the disclosed toridal twelve-sided polygon as shown in table 1 computed according to equations 3 and 4. The exemplary values shown in Table 1, as would be recognized by those skilled in the art, vary with core flux density (B) and wire conductivity (σ). The data with rectangular forms represent actual commercial values compared to those determined with the toroidal polygon forms under the same given values for σ, B, d, etc. and operating voltage and current conditions.

Figure 4:
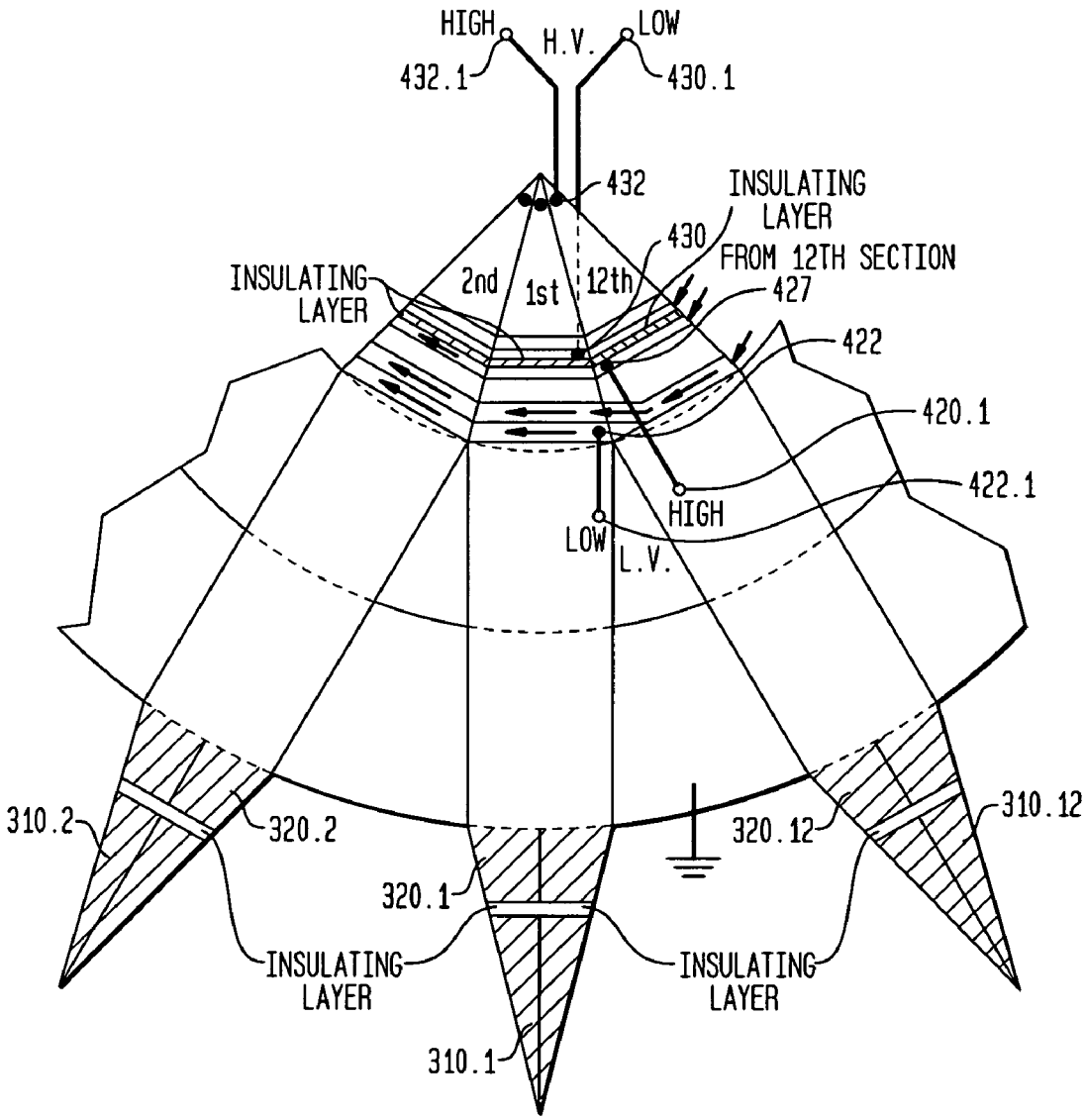
FIG. 4 illustrates an exemplary coupling of winding sections of the toroidal star-shaped transformer shown in FIG. 3A.

FIG. 4 illustrates, in an expanded form, select ones of the trapezoidal shaped radial first and second windings and an exemplary serial connection configuration of the star-shape toroidal transformer shown in FIG. 3A such that a continuous electrical path is created among each of the winding sections. In this case, an end (420) of the first winding of the $12^{th}$ section 320.12 may be electrically connected to an end (422) of the first winding of the $1^{st}$ group 320.1. A similar connection is made for the second winding section wherein an end (430) of second winding of the $12^{th}$ winding section 310.12 may be electrically connected to an end (432) of the second winding of the $1^{st}$ winding section 310.1. Similar connections are made for the other winding sections (both first and second winding) to achieve a continuous electrical path of first and second windings. Points 421.0 and 422.1 represent nodes that are electrically connected to the associated first winding endpoints to allow access to these points outside the illustrated transformer. Similarly points 430.1 and 432.1 represent nodes that are electrically connected to the associated second windings endpoints to allow access to these points outside the illustrated transfer. Although the above description teaches the serial connection of end 420 and end 422, it should be recognized that this is only for illustrative purposes to show the serial nature of the electrical connection between section windings. Furthermore, although a serial connection of the windings is shown herein, it would be recognized by those skilled in the art that the windings may also be connected in parallel or in a combination of serial and parallel connections. With regard to a three-phase transformer configuration, only those winding sections associated with a winding group are electrically connected as described.

FIG. 4 further illustrates that in a step-up transformer configuration, the input terminals are indicated by connections 420 and 422 and the output terminals are indicated by connections 430 and 432, while in a step-down configuration, the input terminals are indicated by terminals 430 and 432 and the output terminals are indicated by terminals 420 and 422.

Figure 5:
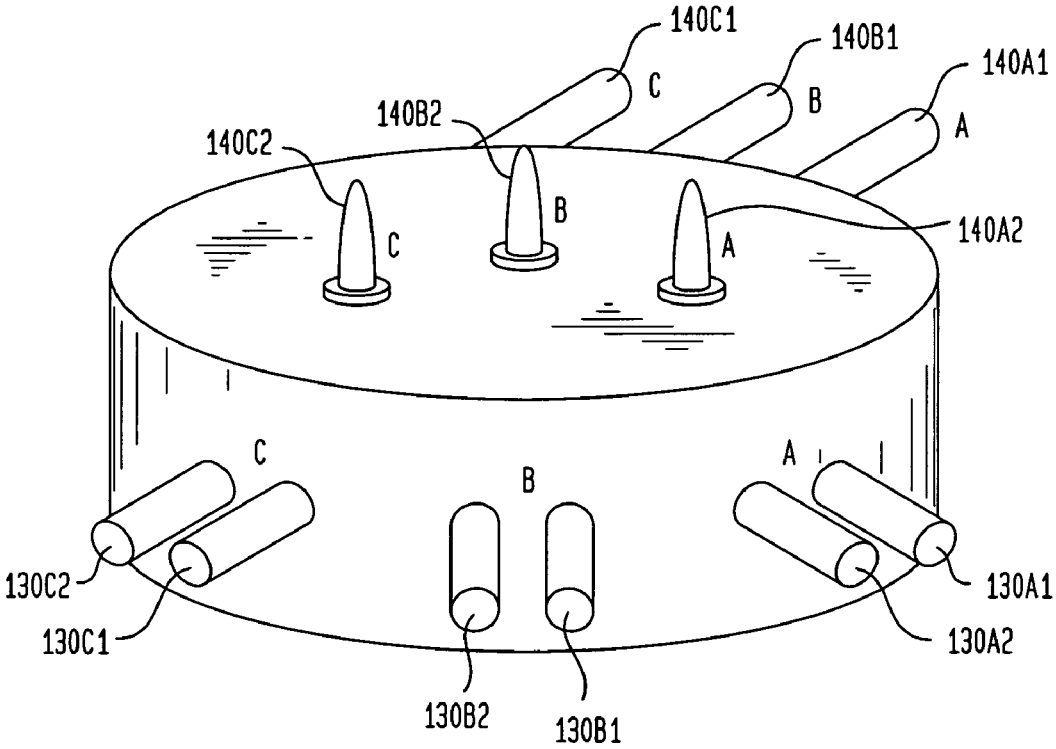
FIG. 5 illustrates a flat-cylinder container box housing a toroidal transformer equipped with insulated and isolated high-voltage post terminals.

FIG. 5 illustrates an exemplary packaging of a grounded cylindrical container housing a three-phase toroidal transformer in accordance with the principles of the invention. As shown terminals associated with low voltage inputs (130 A, B, C) and high voltage low-end outputs (140A1, B1, C1) are located on, and insulated from the container wall. The high voltage outputs (140A2, B2, C2) carrying the highest potentials are properly insulated and installed at the top of the container. It is well recognized that with a grounded core none of these winding terminals are connected to the ground, thus, leaving options for users to select "Y" or "Δ" connections suitable for a plurality of application demands.

While there has been shown, described, and pointed out fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A toroidal power transformer comprising:

a circular core composed of plurality of laminated electrically conductive materials:

a plurality of multi-layered first windings radially wound around the circular core, said winding arranged with an angular spacing of 2θ and a number of windings in each winding layer is less than a number of windings in each previous layer;

a multi-layered second winding radially wound around the circular core covering a corresponding one of said plurality of first windings, wherein the layers of each of said second windings are arranged to form a substantially triangular cross-section; and an insulating layer between each of said first and second windings.

2. The power transformer recited in claim 1, wherein the number of layers in said first windings are arranged to create a substantially triangular cross-section.

3. The power transformer recited in claim 1, wherein the number of layers in said first windings are arranged to create a substantially trapezoidal cross-section.

4. The power transformer recited in claim 1, wherein the angular spacing 2θ is determined as $2\pi/\alpha$, wherein α represents the number of said plurality of first windings.

5. The power transformer recited in claim 1, wherein the plurality of first and corresponding seconding windings are arranged in a plurality of windings groups, wherein each wring group has a substantially same input voltage but a different phase.

6. The power transformer of claim 1, further comprising:

terminals located at an outer circumference of said circular core, at least one terminal associated with a corresponding one of said first windings.

7. The power transformer recited in claim 5 wherein the electrical phase difference among the winding groups is determined as (360 degrees/n), wherein n is the number of winding groups.

8. The power transformer of claim 7, wherein the winding groups are composed of selected adjacent ones of said plurality of first and corresponding second windings.

9. The power transformer of claim 7, wherein the winding groups are composed of alternate ones of said plurality of first and corresponding second windings.

10. The power transformer of claim 9, wherein said alternate ones of said plurality of first and corresponding second windings are determined as a function of the number of winding groups, n.

11. The power transformer of claim 10, wherein outputs from said second windings are located at an inner circumference of said circular core.

12. A circular power transformer comprising:

a plurality of input terminals located on an outer circumference of said power transformer;

a plurality of output terminals located substantially in a center of a planar surface of said power transformer; and a circular core including a plurality of first windings connected to corresponding ones of said input terminals and a plurality of second windings connected to corresponding ones of said output terminals, said first windings radially wound around the circular core in a plurality of layers, wherein said first winding being arranged about said core with an angular spacing of 2θ and said second winding radially wound around the circular core in multiple layers and covering a corresponding one of said plurality of first windings, wherein the layers of each of said second windings are arranged to form a substantially triangular cross-section; and an insulating layer at least between each of said first and second windings.

13. The power transformer of claim 12, wherein a number of windings in each of said multiple layers of said first winding is less than a number of windings in a previous layer.

14. The power transformer recited in claim 12, wherein the number of layers in said first windings are arranged to create a substantially triangular cross-section.

15. The power transformer recited in claim 12, wherein the number of layers in said first windings are arranged to create a substantially trapezoidal cross-section.

16. The power transformer recited in claim 12, wherein the angular spacing 2θ is determined as $2\pi/\alpha$, wherein α represents the number of said plurality of first windings.

17. The power transformer recited in claim 12, wherein the plurality of first and corresponding seconding windings are arranged in a plurality of groups of windings, wherein each wiring group has a substantially same input voltage but a different phase.

18. The power transformer recited in claim 17 wherein the electrical phase difference among the wiring groups is determined as (360 degrees/n), wherein n is the number of winding groups.

19. The power transformer of claim 18, wherein the winding groups are composed of selected adjacent ones of said plurality of first and corresponding second windings.

20. The power transformer of claim 18, wherein the winding groups are composed of alternate ones of said plurality of first and corresponding second windings.

21. The power transformer of claim 20, wherein said alternate ones of said plurality of first and corresponding second windings are determined as a function of the number of winding groups, n.

* * * * *